United States Patent [19]

Watanabe et al.

[11] 4,199,829

[45] Apr. 29, 1980

[54] NURSING SYSTEM

[75] Inventors: Shigeru Watanabe, Tanashi; Michiyasu Ishida, Nagaokakyo; Hideo Iwasaki, Kyoto, all of Japan

[73] Assignee: Mitsubishi Jukogyo Kabushiki Kaisha, Tokyo, Japan

[21] Appl. No.: 870,829

[22] Filed: Jan. 19, 1978

[30] Foreign Application Priority Data

Jan. 26, 1977 [JP] Japan ..... 52-7546

[51] Int. Cl.[2] ..... A61G 7/08

[52] U.S. Cl. ..... 5/81 R; 5/86; 5/90

[58] Field of Search ..... 5/81 R, 83, 86–88, 5/90, 92; 212/21, 128; 214/1 BC; 297/217; 4/177, 185 L, 185 R

[56] References Cited

U.S. PATENT DOCUMENTS

| | | | |
|---|---|---|---|
| 834,477 | 10/1906 | Kline | 5/88 |
| 1,385,424 | 7/1921 | Billings | 5/81 R |
| 3,123,224 | 3/1964 | Kral | 5/81 R |
| 4,085,471 | 4/1978 | Di Matteo et al. | 5/81 R |

FOREIGN PATENT DOCUMENTS

| | | | |
|---|---|---|---|
| 1412153 | 10/1975 | United Kingdom | 5/81 R |

*Primary Examiner*—Casmir A. Nunberg
*Attorney, Agent, or Firm*—Sherman Levy

[57] ABSTRACT

A nursing system enables a bedridden patient or handicapped person to move unattended from his bed or wheelchair to a toilet, bathtub, or other nursing aid, and vice versa, with ease of shifting.

7 Claims, 4 Drawing Figures

NURSING SYSTEM

This invention relates to a nursing system for invalid persons, especially for bedridden patients.

Lifts for raising a bedridden patient or other invalid person from a wheeled vehicle into a bathtub or onto a lavatory seat have already been developed. With those aids, however, the patient still finds it difficult to move from the bed to the wheeled vehicle and thence to the lift, and contrariwise; in every case, he has to rely upon some other person for help.

The present invention aims at overcoming such difficulties and providing a nursing system which helps the patient to shift in the recumbent posture from his bed to a wheeled vehicle or lift and to take a bath and ease nature by himself, thus saving the labor of nurse, protecting the privacy of the patient, and promoting his desire for rehabilitation.

The invention will be better understood from the following description of an embodiment illustrated in the accompanying drawings.

Figure 1:
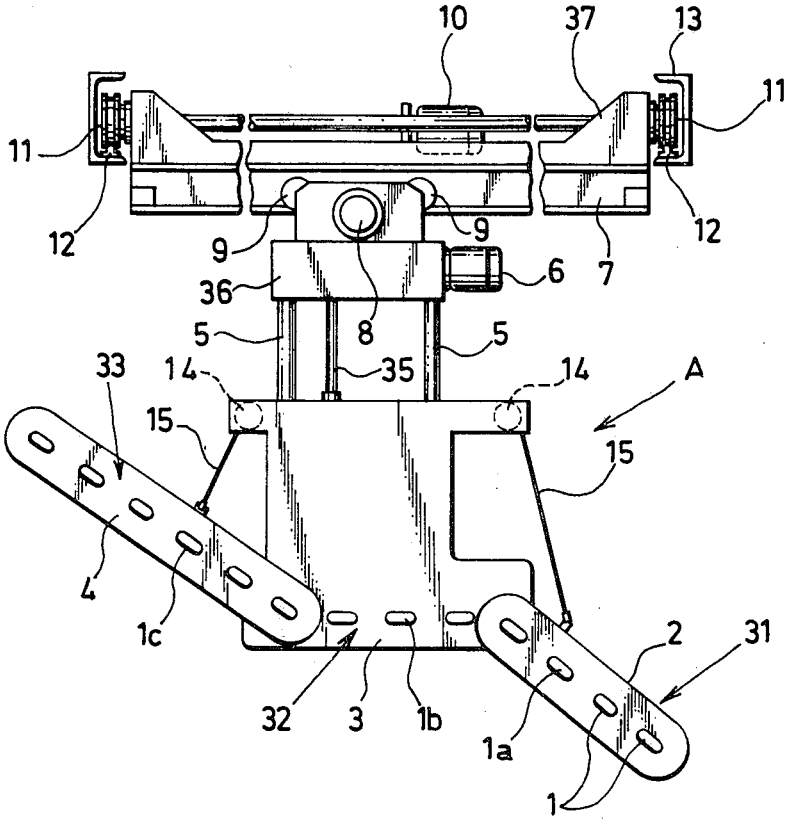
FIG. 1 is a side view of a patient carrier and a transferring apparatus of the nursing system according to the invention.
Figure 2:
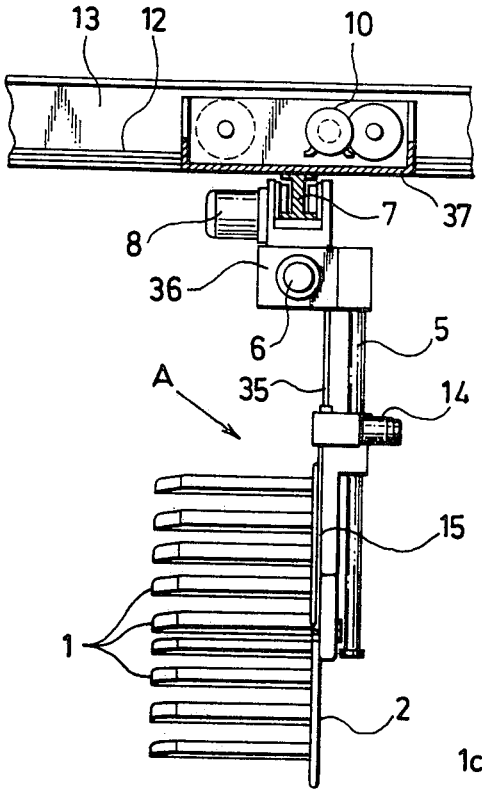
FIG. 2 is a front view of the arrangement shown in FIG. 1.
Figure 3:
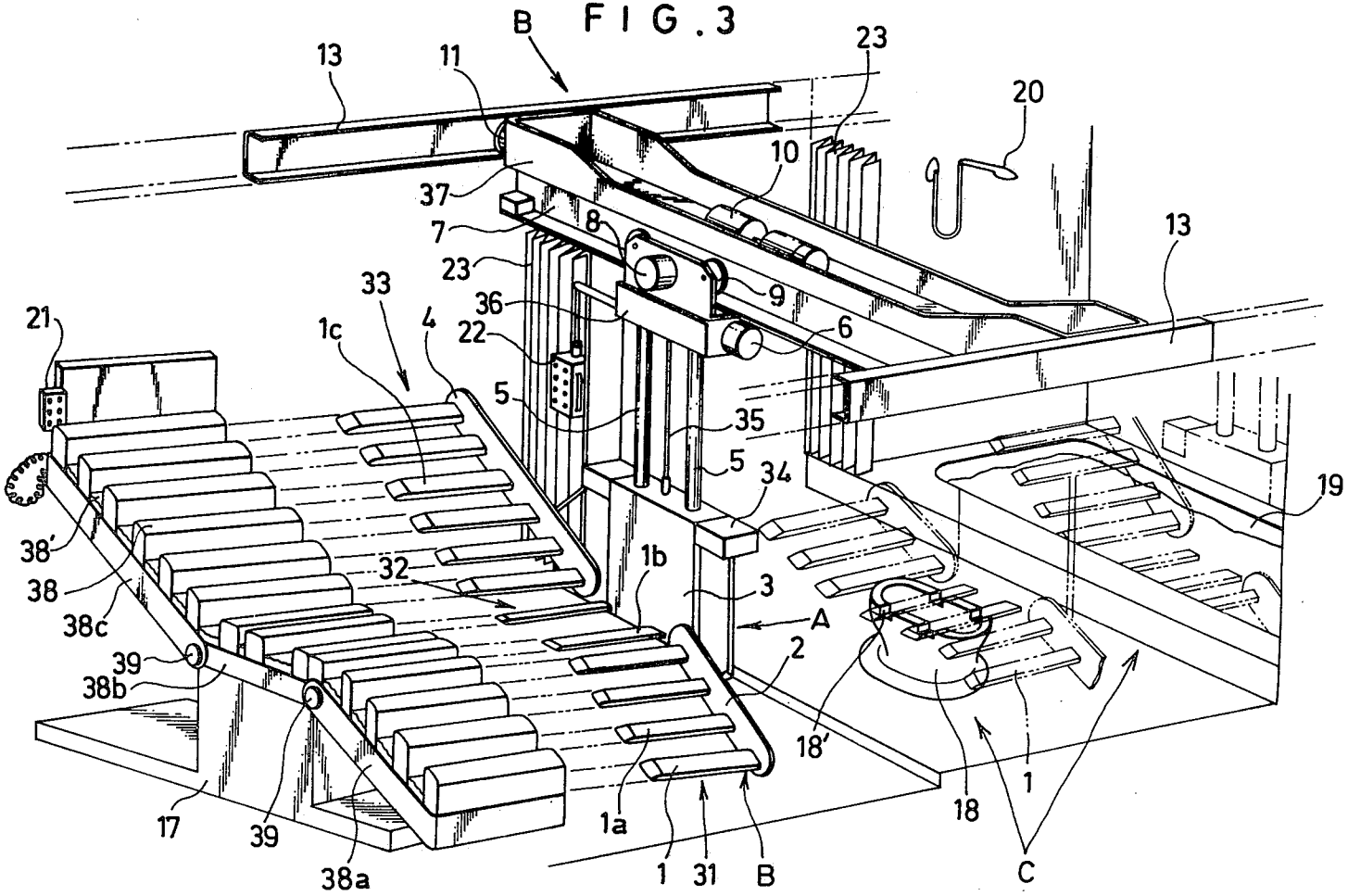
FIG. 3 is a general perspective view of the nursing system of the invention.

Referring now to FIGS. 1 through 3, there are shown a patient supporter and a transferring apparatus embodying the invention. A number of forks 1 are parallelly arranged in a row to support a patient to be shifted from place to place. These forks 1, as divided into three groups, are secured at one ends to, and supported by, side plates 2, 3, 4. The groups of forks 1*a*, 1*b*, 1*c* secured to the side plates 2, 3, 4, respectively, constitute a footrest 31, seat 32, and backrest 33. The side plates 2, 3, 4 are pivotally connected by pins (not shown) to turn relative to one another, and the side plate 3 serves also as a frame 34 of the patient carrier, which is generally designated A. The frame 34 is suspended by a wire 35 from a trolley 36 of the transferring apparatus, generally designated B, to be described later, and can be hoisted by a motor 6 mounted in the trolley. Guide rods 5 are provided for the upward and downward movement of the frame 34. Guide rails 7 are supported by the a bridgelike beam structure 37 so that the trolley 36 with wheels 9 can be moved back and forth along the rails 7 by a built-in drive motor 8. Overhead trackage 13, having rails 12 along which the bridge structure can be moved sideways, is fixed to the upper part of the room. The bridge structure 37 carries a drive motor 10 and wheels 11, by which it can travel leftwardly and rightwardly along the rails 12. Motors 14 are mounted in the side plate 3 to raise and lower the other two side plates 2, 4 with the aid of connecting wires 15 and thereby change their angles to the middle side plate 3.

Now the system incorporating the afore-described patient carrier A and apparatus B for transferring the carrier will be described. FIG. 3 shows nursing aids C, namely, a bed 17, toilet 18, and bathtub 19, all disposed within the area over which the transferring apparatus B can operate. A mat 38 on the bed 17 is adapted to sink at regular intervals to provide corresponding furrrows to receive the forks 1 of the patient carrier A. Whenever the patient is to move out of his bed 17, the mat 38 is partially deflated to provide alternate lands and furrows or recesses, and the forks 1 are inserted into the resulting recesses and raised with the patient lying instead on the forks. The alternate lands and furrows on the bed 17 may be formed in a variety of ways. The portions 38' of the mat 38 to form the recesses for receiving the forks 1 may take the form of an air mat from which air can be forcibly drawn out. Conversely, the rest of the mat may consist of an air mat which, when inflated with air, can form lands, leaving furrrows in between. As a further alternative, the mat may be partially moved upwardly and downwardly by mechanical means to provide the necessary recesses. The bed 17 can be manipulated with the same driving system as used in a typical dental chair, so that the backrest 38*c* and footrest 38*a* can turn about pivots 39 with respect to the seat 38*b*, the backrest 38*c* moving upwardly and the footrest 38*a* downwardly. The bed may be of a self-propelled type.

The nursing system of the invention, with the construction described, is used in the following way.

When a patient or other invalid on the bed 17 desires to ease nature, he (1) causes the mat 38 of the bed 17 to sink partially so as to provide recesses at regular intervals, (2) actuates the drive motors 6, 8, 10 of the transferring apparatus B and the drive motor 14 of the patient carrier A to insert the forks 1 of the patient carrier into the recesses 38' of the mat 38, and then (3) actuates the drive motor 6 of the transferring apparatus A to raise the frame 34 and therefore the forks 1 until the patient is raised off from the bed. Next, (4) the patient or the like on the forks 1 has the wheels 11 on the runway rails 12 driven by the motor 10 to move the bridge structure 37 rightwardly as viewed in FIG. 3 until he is carried to a preselected point above the toilet 18, and (5) again the motor 6 is driven to lower the forks 1. In this way the patient or the like is allowed to sit on the toilet. Where necessary to avoid the interference with the forks 1, the toilet has partial recesses 18' formed on the top surface. While the patient is easing nature, he is demounted from the forks 1 of the patient carrier A, and the transferring apparatus B is kept aside, on the "good" side of the patient. Alternatively, the fork arrangement may be devoid of the forks 1 that can obstruct the urination and defecation.

When the patient or invalid on the bed 17 desires to have a bath, he is carried by the forks 1 to a preselected point above the bathtub 19 in the same manner as when proceeding toward the toilet. Then, again in the same way, he lowers the forks 1 to take either a bath or a shower from a nozzle 20. While bathing, he may remain sitting or lying on the forks within the tub. In FIG. 3 are shown operation boxes 21, 22 for the operational control of the transferring apparatus B and the patient carrier A. They are located within the reach of the patient, whether on the bed 17 or the forks 1, for free control by himself. The entire system may be so coordinated that, if the patient presses a "toilet" push button, the above-described sequence of operations are automatically performed, enabling the patient to ease nature. The numeral 23 indicates accordion curtains for the privacy of the patient.

Figure 4:
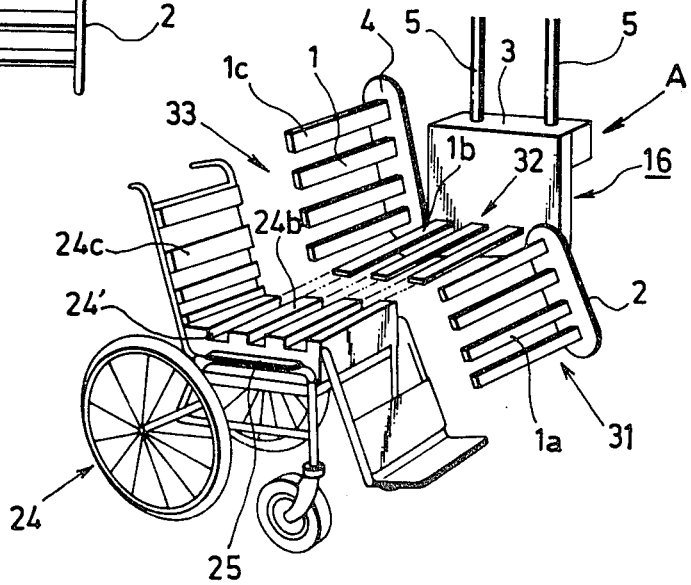
FIG. 4 is a perspective view of the patient carrier approaching a wheelchair.

FIG. 4 illustrates how the patient is shifted from the carrier A to the wheelchair 24 or contrariwise. Of the wheelchair 24, the seat 24*b* and backrest 24*c* have furrows or recesses 24' of a construction similar to that of the mat 38 on the bed 17. Armrests 25 on both sides of the chair are retractable and can be raised and secured in position when needed. Prior to the operation of the patient carrier A and the transferring apparatus B, the armrests 25 are retracted downwardly and cleared as shown out of the way of the forks 1.

For the transfer of the patient from the wheelchair 24 to the patient carrier A, the chair is first brought alongside the carrier, and the motor 6 of the transferring apparatus B is switched on to move and adjust the height of the forks 1 of the carrier A to the same level as the seat of the wheelchair 24. Next, the motor 10 of the transferring apparatus B is started to move the patient carrier A sidewise, its forks 1 are inserted into the recesses 24' of the chair, and the motor 6 of the transferring apparatus B is used to raise the patient carrier A and therefore the patient himself on the forks out of the chair.

Conversely when the patient is to shift from the carrier A to the wheelchair 24, the group of forks 1c forming the backrest 33 of the patient carrier A is raised to an angle sharper than that of the backrest 24c of the wheelchair 24, the motor 10 of the transferring apparatus B is turned on to bring the patient carrier A over the chair while, at the same time, the motor 6 of the apparatus B is actuated to lower the patient carrier A gradually until the group of forks 1b forming the seat 32 of the patient carrier A are seated on the recesses 24' in the seat 24b of the wheelchair 24. As soon as the patient sits on the wheelchair 24 with his hips resting stably on the lands between the furrows or recesses 24' of the seat, the motor 14 of the patient carrier A is switched on and the side plate 4 is reclined to the extent that the group of forks 1c forming the backrest 33 fits in the corresponding recesses 24' of the backrest 24c of the wheelchair 24. This permits the patient to shift completely onto the wheelchair 24. The motor 10 of the transferring apparatus B is actuated to move the patient carrier A sidewise and accordingly pull the forks 1 away from the recesses 24' of the wheelchair 24. The sequential steps explained above enables the patient to move from the wheelchair 24 to the patient carrier A, and vice versa. The motor 8 of the transferring apparatus B, which is used to move the patient carrier A back and forth, may be omitted if the bed 17, toilet 18, and bathtub 19 or the like are in properly prearranged locations to remove the necessity of the backward and forward movement.

As described in detail, the system of the invention includes the nursing aids, such as the toilet and bathtub, disposed within the reach of the patient carrier, and therefore the patient in his bed or wheelchair can easily have a ride on the carrier and go to the toilet or bathtub by himself. The patient carrier has a row of forks arranged in parallel and supported only at one ends, which forks can be inserted into corresponding recesses formed in the bed or chair and then raised or pulled out. The carrier thus renders it possible for the patient to move easily from his bed or chair to the patient carrier, and vice versa, with little helper assistance. The operation box for controlling the transferring apparatus that moves the patient carrier back and forth, sidewise, and vertically may be located in any convenient point accessible to the patient; the system is then operable under the control of the patient himself and helping hand is no longer needed. The present invention is applicable to mechanical systems regarded as nurse robots, such as the means for enabling the patient to move from place to move, take a bath, or ease nature.

What is claimed is:

1. A nursing system comprising: patient carrier means having a number of forks supported at one ends by side plates so as to constitute a backrest, seat, and footrest; transferring means having runway rails secured in preselected locations, and a trolley adapted to travel along said rails, said trolley holding said patient carrier means in such a manner as to permit upward and downward movement of said carrier means; nursing aids, such as a toilet and bathtub, disposed within the reach of said patient carrier means; and a bed having a plurality of lands and furrows, or alternately raised and sunken portions formed on the mat surface correspondingly to said forks of said patient carrier means.

2. A nursing system according to claim 1, wherein said backrest and footrest of the patient carrier means are reclinable with respect to said seat of said means.

3. A nursing system according to claim 1, wherein said furrows or sunken portions of said mat surface of said bed may be projected, when desired, so as to be flush with said lands or raised portions.

4. A nursing system according to claim 1, wherein said bed comprises a backrest, seat, and footrest, and said backrest and footrest being reclinable with respect to said seat.

5. A nursing system according to claim 1, wherein said toilet as a nursing aid has recesses provided on the top surface so as to receive said forks of said patient carrier means.

6. A nursing system comprising: patient carrier means having a number of forks supported at one ends by side plates so as to form a backrest, seat, and footrest, said backrest and footrest being reclinable with respect to said seat; transferring means having runway rails secured to the ceiling of a room or the like, and a trolley adapted to travel along said rails, said trolley holding said patient carrier means in such a manner as to permit upward and downward movement of said carrier means; nursing aids, such as a toilet and bathtub, 4isposed within the reach of said patient carrier means, and a wheelchair having a backrest, seat, and footrest on the chair body, said backrest and seat being formed with spaced apart recesses for receiving said forks of said patient carrier means, and armrests also provided on, and made retractable into, said chair body.

7. A nursing system according to claim 6, wherein said toilet as a nursing aid has recesses formed on the top surface to receive said forks of said patient carrier means.

* * * * *